United States Patent [19]

Love

[11] Patent Number: 4,589,351

[45] Date of Patent: May 20, 1986

[54] VERTICAL SUPPORT APPARATUS

[76] Inventor: Norman H. Love, R.R. #1, Maple Beach Rd., Beaverton, Canada, L0K 1A0

[21] Appl. No.: 664,022

[22] Filed: Oct. 23, 1984

[51] Int. Cl.[4] ..... A47B 3/00

[52] U.S. Cl. ..... 108/111; 24/115 M; 108/105; 108/106; 108/110; 108/144

[58] Field of Search ..... 108/149, 151, 111, 106, 108/105, 144, 148, 110; 24/136 L, 115 M; 312/254

[56] References Cited

U.S. PATENT DOCUMENTS

| | | | |
|---|---|---|---|
| 1,418,435 | 6/1922 | Gardiner | 248/244 |
| 2,556,105 | 6/1951 | Rhett | 108/106 |
| 2,987,359 | 6/1961 | Kennon | 312/254 X |
| 3,273,519 | 9/1966 | Duboff | 108/105 |
| 3,709,166 | 1/1973 | Bush | 108/106 |
| 3,756,168 | 9/1973 | Bushyshead | 108/111 |
| 3,778,868 | 12/1973 | Kelly | 24/115 M |
| 3,879,147 | 4/1975 | Norell | 24/115 M |
| 3,975,799 | 8/1976 | Kerr | 24/115 M |
| 4,061,092 | 12/1977 | Jackobsen | 108/149 |
| 4,318,352 | 3/1982 | Freidman et al. | 108/111 |

*Primary Examiner*—James T. McCall

*Attorney, Agent, or Firm*—George A. Rolston

[57] ABSTRACT

A shelf apparatus comprising, a plurality of vertical supports, at least one shelf defining holes whereby the shelf may be slidably located on the vertical supports, two wedge clamps adaptable to at least partially fit within each hole whereby the shelf will press the wedge clamp against the vertical support.

3 Claims, 3 Drawing Figures

FIG. 1.
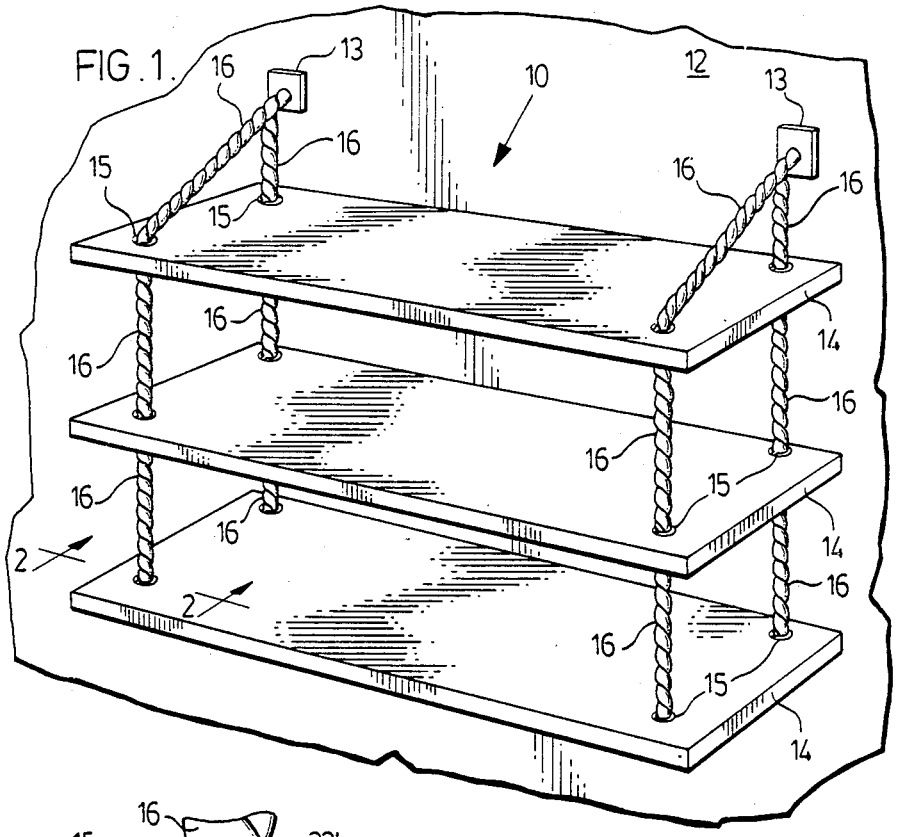
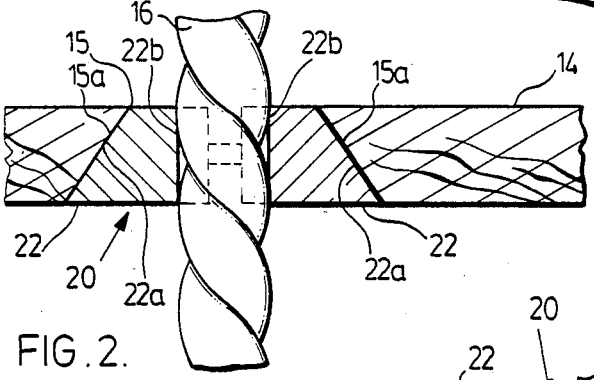
FIG. 2.
FIG. 3.
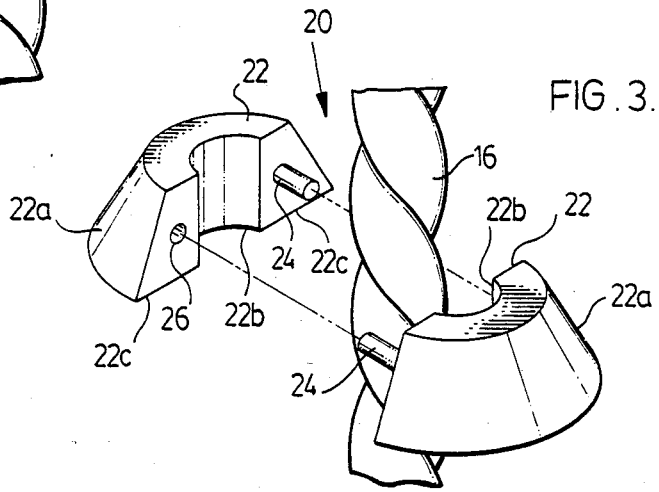

VERTICAL SUPPORT APPARATUS

NATURE OF THE INVENTION

This invention relates to a device for adjustably supporting an object at a predetermined vertical position, and in particular to a device for adjustably supporting shelves.

BACKGROUND OF THE INVENTION

It is often desirable to have shelving in a home, office or warehouse adjacent a smooth flat wall. Typically, a free standing shelf unit may simply be placed at the desired location. Alternatively, wall brackets may be used to support the shelves directly on the wall. However, in many cases it is desirable to install shelving that is vertically adjustable, that is whereby the height of individual shelves may be changed from time to time in relation to each other and to the floor.

Many such adjustable shelves exist. However, such shelf systems suffer from a variety of disadvantages. In one common shelf system, the shelf unit includes a frame. Attached to the frame are four vertical tracks. Each track receives a shelf supporting bracket which can be placed at any desired vertical location along the track. Such a shelf system typically requires an expensive and possibly heavy frame. Furthermore, the design of shelves may be limited to particular designs which may not be suitable for all decors. Also, such units generally are freestanding units. For safety reasons it may be desirable to attach such a free-standing unit to the wall, but in many instances this may be difficult to do. Of course built-in designs are possible, but such designs are relatively expensive, time consuming to construct and limited in their portability.

Accordingly, hanging shelf systems easily attachable directly to the wall have been proposed. For example, U.S. Pat. No. 2,556,105 illustrates a shelf system wherein the shelves are attached to four chains which are suspended from brackets attached to the wall. A disadvantage of U.S. Pat. No. 2,556,105 is that the means for attaching the shelves to the chain specifically require the use of chain. In other words, other vertical support means such as rope or smooth tubular members (which may be desirable for aesthetic or other purposes) could not be used. Both in U.S. Pat. No. 2,556,105 and in many other shelf designs, means are provided for attaching a shelf to a specific vertical support member. However such attachment means are limited only to the use in association with the specified vertical support member.

Accordingly, it is desirable to provide a means for attaching a shelf to any vertical member which is convenient to use, reliable, inexpensive, and yet which does not detract from the aesthetic appearance of the shelves.

STATEMENT OF THE INVENTION

With a view to overcoming the foregoing problems and to providing the advantages discussed, the invention comprises a shelf apparatus comprising a plurality of vertical support members, at least one shelf defining holes whereby the shelf may be slidably located on the vertical support members, two wedge clamps adaptable to at least partially fit within each said hole whereby the shelf will press the wedge clamp against the vertical support member.

The invention provides the following advantages.

Two wedge clamps are provided to clamp onto a variety of vertical support members, including rope, chain, smooth poles (having rounded, flat or other surfaces), and the like. The material of the clamp can be varied according to the type of material from which the vertical support member is construced in order to achieve maximum frictional clamping. Installation is simple, rapid and convenient. The two wedges must simply be placed at the desired location and held there briefly while a shelf is lowered into place thereupon. No screws, clamps, bolts or other fasteners are required. The vertical support member is not required to be provided with any notches or openings at certain locations to support a shelf-supporting member. The wedges may be located at any position along the height of the vertical member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a perspective view of a shelf apparatus according to the invention;

FIG. 2 is a cross-section along the line 2—2 of FIG. 1 illustrating wedge clamps according to the invention in use, and;

FIG. 3 is an expanded perspective drawing of the wedge clamps according to the invention shown in use.

DESCRIPTION OF A SPECIFIC EMBODIMENT

Referring to FIG. 1, there is illustrated a shelf apparatus 10 according to the invention. Shelf apparatus 10 is mounted to wall 12 by wall brackets 13. Apparatus 10 includes a plurality of horizontal shelves 14 adjustably secured (as discussed below) to vertical support members 16. Shelves 14 are provided with receptor openings, for example holes 15, through which vertical support members 16 may extend. In turn, vertical support members 16 are secured to brackets 13, which are mounted to wall 12.

In the illustrated embodiment, upper shelf 14 abuts against wall 12. However, in other embodiments shelves 14 may be suspended away from wall 12 by use of alternate wall bracket means.

The vertical support members 16 illustrated in FIG. 1 are ropes. However, it will be appreciated that any suitable vertical support means, such as chains, cables, or other flexible members or rigid poles could be used. Although the description and Figures herein illustrate verrtical support members attached to a wall bracket, it will be appreciated that such vertical support members may be otherwise supported, for example from a ceiling, a floor or otherwise. Accordingly, it is not intended to restrict the scope of the invention to the particular shelf apparatus illustrated. Rather it is the intention that the scope of the invention include any application wherein the support apparatus according to the invention could be used.

Referring to FIGS. 2 and 3, a shelf supporting means, indicated generally as 20, for holding a shelf 14 to a vertical support member 16 is shown. Hole 15, through which a vertical support member 16 passes, defines at least one angled surface 15*a*. Preferably for ease of manufacturing, hole 15 is essentially circular in plan view and surface 15*a* defines a truncated conical surface, tapering upwardly. Shelf supporting means 20 comprises two cooperating wedge clamps 22. Wedge clamps 22 cooperate with each other to essentially surround vertical support member 16. Each wedge clamp 22 defines an outer surface 22*a* adapted to cooperate with the angled surface 15*a* of hole 15. Each wedge clamp 22 also defines an inner surface 22*b* adapted to fit around a portion of the outer perimeter of vertical support member 16. Preferably each inner surface 22*b* is adapted to fit around slightly less than half of the outer perimeter of member 16. Wedge clamp 22 also defines side surfaces 22*c* disposed on either side of vertical support member 16. One such side surface 22*c* defines an outwardly extending abutment 24. The other side surface 22*c* defines a recess 26.

The other wedge clamp 22 is essentially identical to the first wedge clamp 22. The recess 26 of one wedge clamp 22 is adapted to receive the abutment 24 of the other wedge clamp 22.

In operation, a pair of wedge clamps 22 is selected and positioned by hand at the desired vertical height for shelf 14. The wedge clamps 22 are aligned on either side of vertical support members 16 whereby the abutment 24 of one wedge clamp 22 fits within the recess 26 of the other wedge clamp 22. The two wedge clamps 22 are squeezed together lightly by hand in order to obtain friction between the wedge clamps 22 and the vertical support member 16. In this fashion, a small force applied by hand to the wedge clamps 22 prevents the wedge clamps 22 from moving relative to the vertical support member 16. The shelf 14 is lowered into position over the pair of wedge clamps 22. The angled surface 15*a* of hole 15 cooperates with wedge clamps 22 to apply a horizontal force to wedge clamps 22 tending to push them together against the vertical support member 16. A frictional force sufficient to resist the weight of the wedge clamps 22 and shelf 14 (together with any articles on shelf 14) is developed between wedge clamps 22 and vertical support member 16. In this fashion, shelf 14 remains at the desired vertical height.

If it is subsequently desired to adjust the height of shelf 14, shelf 14 is simply raised off of wedge clamps 22 thus decreasing the friction force between wedge clamps 22 and vertical support members 16. Wedge clamps 22 may then be moved to the desired new height and shelf 14 secured at the new height.

It will be appreciated that depending on the materials and surface finish used in the vertical support members 16, the wedge clamps 22 may be constructed of complementary materials in order to achieve the highest possible frictional resistance between the wedge clamps 22 and the vertical support members 16. For instance, if vertical support members 16 comprise smoothly finished polished aluminum tubing, wedge clamps 22 may conveniently be constructed of a resilient or plastic material. However, for instance in the case where a vertical support member 16 comprises a hemp fibre rope, wedge clamps 22 may be constructed of a metal, such as aluminum.

Furthermore, in some cases, again depending on the materials and surface finish used, inner surface 22*b* of wedge clamps 22 may be provided with frictional formations (not shown) to further increase the friction between the wedge clamps 22 and the vertical support member 16.

In further embodiments, the wedge clamps may support any suitable object, not necessarily only shelves. In particular, for example, wedge clamps according to the invention may be used to support cabinets, trays, shelves, planters, chairs or the like.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A support device for use in association with an object and at least one vertical support member, the object defining at least one receptor opening whereby the object may be slidably located on the vertical support member, wherein each said receptor opening is a hole defined by a truncated conical surface, tapering upwardly, in the object, the support device comprising two wedge clamps adapted to at least partially fit within each said receptor opening whereby the object is operable to press said wedge clamps against the vertical support member, wherein each said wedge clamp defines top and bottom planar surfaces in parallel spaced apart planes, an inner surface adapted to contact and be secured against said vertical support member, two planar side surfaces of generally truncated wedge shape in elevation located on opposite sides of said inner surface, normal to said top and bottom surfaces, an outwardly extending abutment on one said side surface along a first axis, and a mating recess on said other of said side surfaces along a second axis, said first and second axes being parallel and spaced apart from one another, the recess of one said wedge clamp being adaptable to slidably receive the abutment of another said wedge clamp, with the said first and second axes of said respective abutments and recesses being aligned, and in registration with one another, and wherein each said wedge clamp defines an outer surface generally corresponding to and operable to co-operate with said conical surface in said receptor opening.

2. A support device as claimed in claim 1 wherein the object comprises a shelf.

3. A support device as claimed in claim 1 wherein said recess comprises a generally cylindrical hole, and wherein said abutment comprises a generally cylindrical peg member, said peg member and said cylindrical hole being dimensioned and oriented to co-operate with one another, to permit sliding engagement along said parallel axes, whereby said wedge clamps may be slid towards and away from one another, with said respective pegs and holes in sliding engagement with one another.

* * * * *